US008776343B2

(12) United States Patent
Masson et al.

(10) Patent No.: US 8,776,343 B2
(45) Date of Patent: Jul. 15, 2014

(54) METHOD FOR MAKING A COMPOSITE METAL PART HAVING INNER REINFORCEMENTS IN THE FORM OF FIBERS, BLANK FOR IMPLEMENTING SAME AND METAL PART THUS OBTAINED

(75) Inventors: Richard Masson, Buc (FR); Patrick Dunleavy, Palaiseau (FR); Jean Michel Franchet, Paris (FR); Gilles Klein, Mery sur Oise (FR)

(73) Assignees: Messier-Bugatti-Dowty, Velizy-Villacoublay (FR); SNECMA, Paris (FR)

( * ) Notice: Subject to any disclaimer, the term of this patent is extended or adjusted under 35 U.S.C. 154(b) by 36 days.

(21) Appl. No.: 13/509,022

(22) PCT Filed: Nov. 24, 2010

(86) PCT No.: PCT/EP2010/068120

§ 371 (c)(1), (2), (4) Date: May 10, 2012

(87) PCT Pub. No.: WO2011/064251

PCT Pub. Date: Jun. 3, 2011

(65) Prior Publication Data

US 2012/0255961 A1 Oct. 11, 2012

(30) Foreign Application Priority Data

Nov. 25, 2009 (FR) ..... 09 58350

(51) Int. Cl.

| | |
|---|---|
| ***B23P 17/00*** | (2006.01) |
| ***B23K 31/02*** | (2006.01) |
| ***B23K 20/00*** | (2006.01) |

(52) U.S. Cl.

USPC ..... 29/419.1; 29/897.2; 29/888.091; 228/124.6; 228/160; 228/195; 228/228

(58) Field of Classification Search

USPC ..... 228/124.6, 160, 195, 228, 232

See application file for complete search history.

(56) References Cited

U.S. PATENT DOCUMENTS

| | | | |
|---|---|---|---|
| 2005/0086789 | A1 | 4/2005 | Twigg |
| 2007/0020134 | A1 | 1/2007 | Pursell |

(Continued)

FOREIGN PATENT DOCUMENTS

| | | |
|---|---|---|
| EP | 1 527 842 | 5/2005 |
| FR | 2 886 290 | 12/2006 |

(Continued)

OTHER PUBLICATIONS

International Search Report Issued Mar. 7, 2011 in PCT/EP10/068120 Filed Nov. 24, 2010.

*Primary Examiner* — Alexander P Taousakis
*Assistant Examiner* — Matthew P Travers
(74) *Attorney, Agent, or Firm* — Oblon, Spivak, McClelland, Maier & Neustadt, L.L.P.

(57) ABSTRACT

During implementing a composite metal part by compaction of an insert having reinforcing fibers in a metal body or container, gas used for compaction may enter the cavity formed in the container for receiving the insert between a lid covering the insert and the container, which can prevent or degrade compaction and diffusion welding of fiber sheaths of the insert therebetween and/or with walls of the cavity. To solve this problem, the present method includes initiating isostatic compaction by a phase including raising and maintaining temperature, followed by a phase including hot-feeding pressurized gas, and machining an assembly to obtain the part. The temperature raising phase includes a diffusion pre-welding of material rigidly connecting the pressure-adjusted walls of the lid and the container. The method can be used for designing parts having a tensile and compression resistance, such as parts for aircraft landing gear.

14 Claims, 2 Drawing Sheets

(56) References Cited

U.S. PATENT DOCUMENTS

| | | | | |
|---|---|---|---|---|
| 2007/0051455 | A1 | 3/2007 | Franchet et al. | |
| 2009/0218837 | A1 * | 9/2009 | Mantkowski | 295/15 |
| 2011/0005061 | A1 | 1/2011 | Masson et al. | |

FOREIGN PATENT DOCUMENTS

| | | |
|---|---|---|
| FR | 2 919 284 | 1/2009 |
| FR | 2 925 896 | 7/2009 |

* cited by examiner

METHOD FOR MAKING A COMPOSITE METAL PART HAVING INNER REINFORCEMENTS IN THE FORM OF FIBERS, BLANK FOR IMPLEMENTING SAME AND METAL PART THUS OBTAINED

INTRODUCTION

The invention relates to a process for manufacturing composite metal parts by the incorporation of internal fibrous reinforcements, particularly ceramic fibers, and also relates to the preform used for implementing the process and to the composite metal part obtained.

The invention relates to the field of metal matrix composites or MMCs.

To reduce the weight of metal parts while still increasing their mechanical strength, both in tension and in compression, it is usually recommended to incorporate fibers, for example carbon fibers, aramid (for example Kevlar®) fibers or ceramic fibers, into the metal matrix. The ceramic fibers, especially silicon carbide SiC fibers, are used in particular for high-performance applications at high temperatures required in the aviation or aerospace fields or in the safety field, for example for braking (with ceramic brakes).

The manufacture of these parts involves the prior production of inserts from metal-coated filaments. The metal provides in particular the elasticity and the flexibility necessary for handling them.

PRIOR ART

A known process for manufacturing such reinforced parts, described for example in the patent document FR 2 886 290, comprises the formation of a coil of coated filaments wound around a mandrel. The coil is then incorporated into a main metal body or container in which a cavity has been machined beforehand, so as to form a housing for the insert. The depth of the cavity is greater than the height of the coil and is shaped in order for a lid tenon to be inserted thereinto.

The lid is welded under vacuum to the periphery of the cavity in order to be sealed during the hot isostatic compaction step, during which the lid is deformed and the coil is compressed by the tenon.

The hot isostatic compaction technique consists in placing the part in an enclosure to which a high pressure, of the order of 1000 bar, and a likewise high temperature (of the order of 1000° C.), are applied for a few hours.

During this treatment, the gaps between coated filaments disappear by creep, the metal sheaths of the coated filaments are welded together and welded to the walls of the cavity, by diffusion welding, in order to form a dense assembly composed of a metal alloy within which the ceramic fibers extend. The part obtained is then machined to the desired shape.

The process makes it possible to manufacture axisymmetric aeronautical parts, such as rotor disks or integrally bladed disks (called blisks), but also nonaxisymmetric parts, such as links, shafts, cylinder actuator bodies, and casings.

However, machining the cavity in the main body is a difficult operation to carry out, especially because of the small fillet radii in the bottom of the cavity between the bottom surface and the side walls. This small fillet radius is necessary in order for the insert, which has a rectangular cross section and is formed from filaments of small radius, to be fitted with as small a clearance as possible. The machining of the corresponding tenon in the lid is not easy either, because of non-emergent angles and because of the fact that it is necessary to have a shape that perfectly matches the cavity.

In addition, when the parts to be produced are not axisymmetric but oblong shape, with an oval shape or else with rectilinear portions, precise fitting over long lengths is difficult to achieve. This is even more difficult for inserts formed from very rigid coated filaments, for example ceramic fibers, which require the formation of housings in which they fit perfectly. The lid must fit exactly into the cavity so as not to let the fibers escape.

The machining therefore generally incurs high manufacturing costs. In particular the machining of the main body of the container with its lid represents a substantial fraction of the total cost of the parts. To reduce these costs and to simplify the steps, the Applicant has developed a manufacturing process in which the cavity houses a rectilinear insert together with the lid, the dimensions of which are set so as to allow it to be positioned on this insert. The cavity is then sealed by a shrink-fitting operation, by reducing the dimensions of the lid when cold, for example by immersing it in liquid nitrogen, after which it expands in the cavity so as to produce a tight fit. The solution thus produces a seal, thereby simplifying the shape of the cavity.

This process is described in the patent application filed on Jul. 4, 2008 under the number FR 08/54589.

However, this solution introduces a high risk of loss of sealing in the cavity of the container housing the lid and the insert during the subsequent hot isostatic compaction operation, for the following reasons.

This operation consists in subjecting the container-insert-lid assembly to a double temperature-rise/pressure-rise cycle. The pressure is exerted by a compacting gaseous fluid, generally argon.

Under the effect of the temperature increase, the stresses generated by the shrink-fitting operation between the lid and the container relax. At the same time, the pressure external to the container also increases and the compacting gas infiltrates into the cavity containing the insert, between the lid and the container. Such infiltration may prevent or degrade the compaction and the diffusion welding of the sheaths of the filaments of the insert to one another and/or to the walls of the cavity.

SUBJECT OF THE INVENTION

To solve this problem, the invention proposes a treatment in which the lid is prewelded to the container prior to the compaction phase.

More precisely, one subject of the present invention is a process for manufacturing composite metal parts by the incorporation of fibrous internal reinforcements, comprising the steps of machining in a metal body or container at least one cavity for housing an insert of corresponding shape comprising reinforcing fibers, of introducing a lid on the insert in the cavity of the container, the lid having walls held pressed against the walls of the facing container, of carrying out a hot isostatic compaction cycle on such a container-insert-lid assembly and of machining said assembly in order to obtain said part. This step of pressing the lid against the container is then continued by a diffusion prewelding heat treatment in which the temperature of the container-insert-lid assembly is raised and maintained, thereby fastening the lid to the container.

Under these conditions, the isostatic compaction is optimized and no longer requires external closure of the container by the lid using a specific weld, thereby reducing the costs while still guaranteeing quality compaction owing to the absence of gas leaking into the insert via the internal preweld.

Preferably, the pretreatment is incorporated into the hot isostatic compaction cycle in which a solely thermal first phase is followed by an external hot pressing phase.

According to particular embodiments:

prior to the prewelding step, a shrink-fitting operation is carried out between the facing walls of the lid and of the container, so as to end up with a tight compression fit between said walls;

this shrink-fitting operation is carried out by cooling the lid in order to reduce its dimensions, before it is inserted into the cavity and then left to expand upon returning to room temperature, and/or by heating the container during this temperature rise in order to increase the dimensions of its cavity by expansion, before the lid is introduced thereinto; and the cooling is carried out by thermal quenching in dry ice or in a liquefied gas, particularly liquid nitrogen.

The subject of the invention is also a metal part preform assembled during the temperature-rise phase of the process defined above. This preform comprises the metal body or container, the reinforcing fiber insert being placed in the cavity formed in the container together with the metal lid placed on the insert in said cavity and fastened to said container.

According to particular embodiments:

the cavity comprises a longitudinal first main part housing the insert and at least a second part as an extension of the first part, the lid comprising a central portion covering the insert and at least one prolongation having a shape corresponding to the second part of the cavity so as to partially envelop the insert on at least two different planes. The lid thus forms a metal block of simple and easily achievable geometry;

the lid comprises a progressive deformation zone between the main portion and at least one prolongation of the lid at the moment of the compaction step;

the insert and the cavity are rectilinear, so that the lid fits precisely in the cavity with the container during the heat treatment phases so as to not let the fibers escape;

the insert has a cross section chosen to be of polygonal, particularly rectangular, oval or circular shape;

the insert is formed from fibers bundled together and coated with metal, particularly titanium, thereby facilitating the diffusion welding during compaction; and the preform has several cavities of elongate shape incorporating inserts of corresponding shape, the cavities being placed along the rectilinear portions, whether parallel or not. This arrangement makes it possible to produce a multiple longitudinal internal reinforcement without using an insert of stretched annular shape with rectilinear branches, which requires adjusting the machining of the cavity for the insert to the shape of the insert, which is a tricky and onerous operation. This multiple reinforcement is obtained without sacrificing the strength of the part, since the fibers essentially work along the longitudinal direction thereof.

BRIEF DESCRIPTION OF THE DRAWINGS

Other features and advantages of the invention will become apparent on reading the following detailed illustrative embodiment, with reference to the appended drawings which show, respectively.

DETAILED DESCRIPTION OF AN EMBODIMENT

In this description, the positioning terms of the "upper" and "lower" type denote the location of objects with respect to the direction of the Earth's gravity.

Figure 1A:
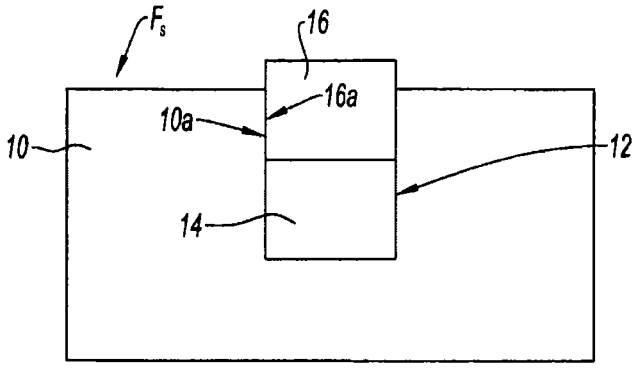
FIGS. 1*a* to 1*c*, schematic cross-sectional views of an example of the implementation of the three main steps of the heat treatment of the process according to the invention.

Referring to the schematic cross-sectional view in FIG. 1*a*, the metal body or container 10 shown is for example intended to form a landing gear link. A cavity 12 has been machined in the container 10 from its upper face $F_s$. This cavity receives an insert 14 in its lower part and a lid 16 in its upper part, the lid covering the insert.

In the example shown in FIG. 1*a*, the lid 16 projects from the upper face $F_s$ of the container 10 for material compensation reasons as mentioned below in the isostatic compaction phase.

The cavity 12, the insert 14 and the lid 16 are of complementary shape and machined so as to have, between them, no clearance or the smallest possible minimum clearance taking into account the technological constraints. In particular, the lid 16 and the container 10 have walls 16*a* and 10*a* that bear against each other by prior application of pressure.

Advantageously, a shrink-fitting operation is carried out between the facing walls of the lid and container by precooling the lid in liquid nitrogen. The lid then shrinks in all directions and is positioned in the cavity on the insert. Upon being heated up as the temperature rises during the prewelding phase that follows, the lid expands in all directions, and the facing walls of the lid and the container then press against each other forming a tight fit.

A hot diffusion prewelding cycle is then carried out in an appropriate enclosure (not shown) capable of subsequently performing the isostatic compaction. The temperature rise and the duration of this cycle are adapted so as to cause the metal of the container to diffuse. The prior pressurization is calculated so as to allow sufficient relaxation of the stresses during this temperature rise.

Figure 1B:
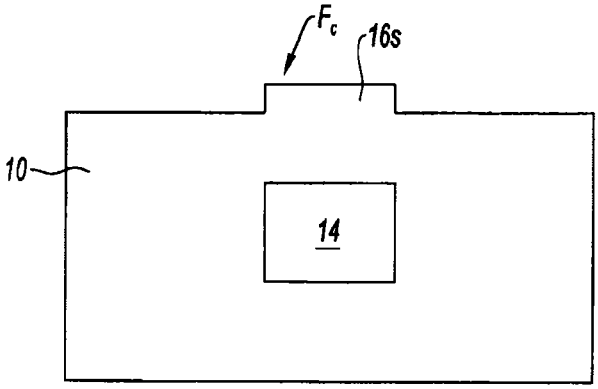

In the example, the metal is a titanium alloy and the welding temperature is between 850 and 1000° C. For titanium alloys, the temperature hold time is at least 30 minutes. This prewelding completely or at least partly fastens the lid to the container. Advantageously, the container and the lid are made of the same metal—a titanium alloy in the example. After this fastening treatment, the container 10 and the lid now form only a single entity surrounding the fibrous insert 14, as shown schematically in FIG. 1*b*, the lid still forming a projection 16*s* on the upper face $F_c$.

Figure 1C:
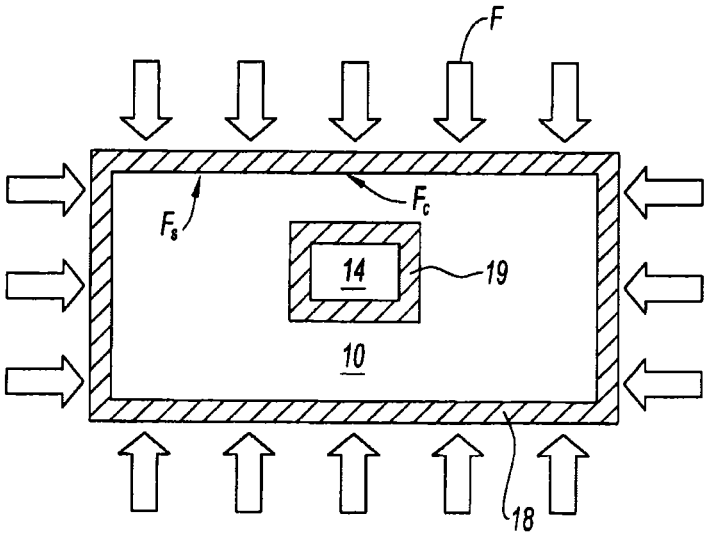

The hot isostatic compaction operation is then carried out, as shown schematically in FIG. 1*c*. The pressure (arrows F) is exerted perpendicularly to all the faces of the container 10, causing the lid to collapse. The injection of the pressurized gas and the temperature, which may reach up to the order of 1000 bar and 1000° C. respectively make it possible for the metal of the matrix of the insert 14 to occupy the spaces between the coated filaments constituting the insert.

The dimensions of the lid are calculated beforehand so that the upper face $F_c$ of the lid 16 becomes, during pressurization, level with the upper face $F_s$ of the container 10, knowing that the volume of the insert decreases by about 15 to 20%. At the end of the process, the container, the lid and the fibers are compacted, as indicated by the shrinkage volumes 18 and 19 shown cross-hatched in FIG. 1*c*.

The blank of the part is thus reinforced by the filaments imprisoned within the matrix. A final machining operation serves to obtain the part with the desired shape.

Figure 2A:
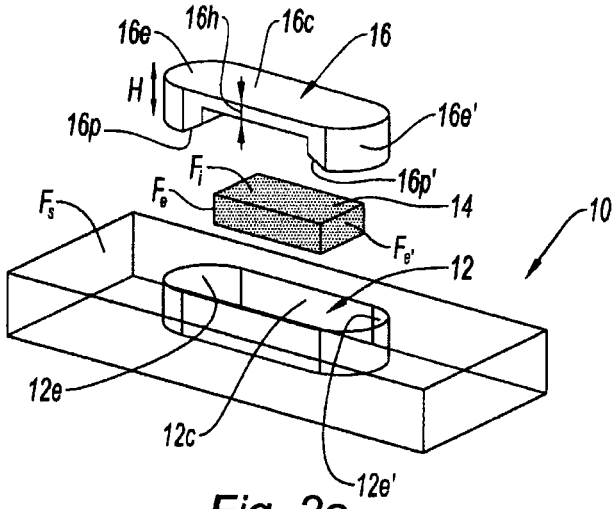
FIGS. 2*a* and 2*b*, perspective see-through views of an example of an assembly operation for producing a metal part preform according to the invention.
Figure 2B:
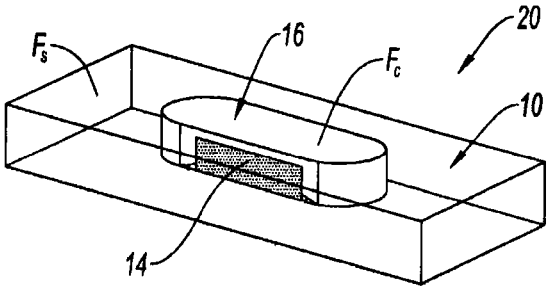

The perspective views shown in FIGS. 2*a* and 2*b* specifically illustrate the assembling of the components for the purpose of producing a preform 20. The components comprise the container 10 of elongate shape, having the cavity 12, which is also of elongate shape, the rectilinear insert 14 and the lid 16 in the form of a block.

The machined cavity 12 is rectilinear, with a flat bottom and walls perpendicular to the bottom. The surface where the bottom joins the walls has a small radius of curvature so as to allow the insert 14 to be fitted with as small a clearance as possible. The cavity comprises a central portion 12*c* and two annular end portions 12*e* and 12*e*' forming longitudinal extensions on either side of the central portion.

The central portion 12*c* is intended to serve as housing for the fitting of the rectilinear insert 14. The insert is formed from an assembly of metal-coated ceramic fibers, the metal being titanium in the embodiment example.

The shape of the lid 16 is such as to surround the insert 14 once it has been placed in its housing. The lid 16 has an overall block shape and dimensions adjusted as close as possible to those of the cavity 12, with a central portion 16*c* and end portions 16*e* and 16*e*' forming the longitudinal extensions of the central portion. The end portions allow the lid to surround the insert on its upper face $F_i$ and on its end faces $F_e$ and $F_{e'}$, i.e. on three different planes.

The height H of the end parts 16*e* and 16*e*' of the lid corresponds to the height 16*h* of its central portion 16*c* plus that of the insert 14, and is slightly greater than the depth of the cavity 12. The end portions 16*e* and 16*e*' of the lid each have a beveled face 16*p* and 16*p*' leaving a space at the bottom of the cavity on the insert side. These faces define free spaces that will facilitate the deformation of the lid during compaction.

In the example, the step of fastening the lid to the container in order to obtain the preform 20 is advantageously preceded by a shrink-fitting operation. To do this, the temperature of the lid 12 is suddenly lowered, so as to cause it to shrink in all directions. One simple means of doing so is to immerse it in liquid nitrogen. The lid, after having been cooled, is then easily placed in the cavity. Upon expanding, the lid fits tightly in compression against the side walls of the container.

The isostatic compaction enclosure (not shown) conventionally includes means for regulating the heating within a wide temperature range, possibly up to 1000° C. and above, means for creating a vacuum and means for applying a high pressure of up to 1000 bar and above.

The temperature of the diffusion welding cycle is the temperature for conventionally welding the metal constituting the container and the lid, here a titanium alloy.

Advantageously, the heat treatment, in particular the prewelding, phases are carried out in the compaction installation. The prewelding and the compaction are thus in continuous concatenation.

The upper face $F_c$ of the lid 16 sinks upon being pressurized up to 1000 bar in order to complete the hot isostatic compaction of the preform 20.

More precisely, the insert is formed from a bundle of fibers coated with a titanium alloy. As the treatment results in a volume reduction and a densification of this insert, the lid descends into the cavity in the manner of a piston. The transition zone formed by the beveled faces 16*e* and 16*e*' allows the lid to deform without the shear forces causing any damage to the lid. The blank thus obtained is ready to be machined in order to produce the desired metal part.

The invention is not limited to the embodiment example described and shown.

The pressing of the lid onto the container may be carried out by any means within the competence of a person skilled in the art: by introducing a leaf spring, a mechanical spacer, etc.

Depending on the type of part to be machined, it is necessary to incorporate a number of inserts matched to the structure of the part to be reinforced.

Figure 3:
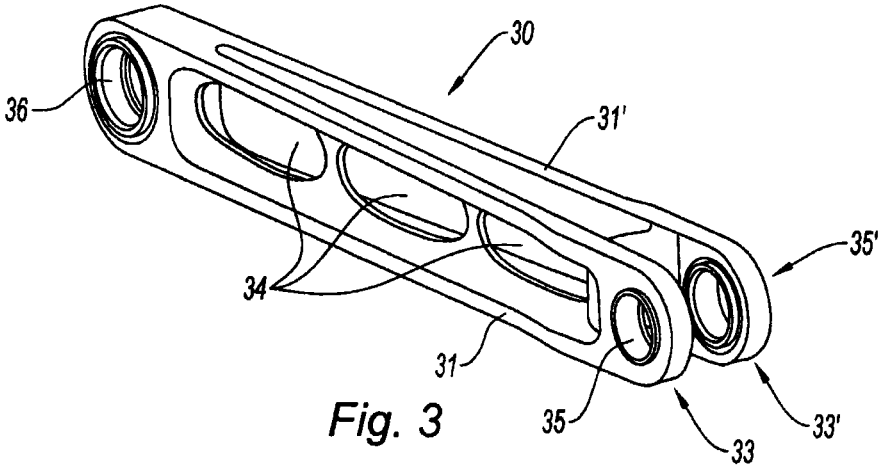
FIG. 3, a perspective view of a landing gear link part incorporating compacted inserts according to the present invention.

Thus, in the link part 30 illustrated in FIG. 3, inserts have been compacted using the method of the invention in each of the rectilinear portions 31 and 31' of each of the nonparallel legs 33 and 33', before the holes 34, 35, 35' and 36 are machined. The inserts ensure transmission of both tensile and compressive loads.

The process of the invention makes it possible under these conditions to produce any part incorporating one or more inserts in longitudinal portions of this part.

Moreover, the shape of the lid may vary and surround the insert partly or completely. In this case, several lids may surround the insert, by providing for example a through-cavity, an insert being placed in the middle of the cavity and two lids placed on either side of the insert from the two opposed faces of the container.

The invention claimed is:

1. A process for manufacturing composite metal parts by incorporation of fibrous internal reinforcements, comprising:

machining in a metal body or container at least one cavity for housing an insert of corresponding shape comprising reinforcing fibers;

introducing a lid on the insert in the cavity of the container, the lid having walls held pressed against walls of the facing container;

heating the lid and the container so as to carry out a diffusion prewelding heat treatment in which the metal of the container diffuses and the lid becomes fastened to the container so as to form a container-insert-lid assembly;

carrying out a hot isostatic compaction cycle on the container-insert-lid assembly; and machining the compacted assembly to obtain the part, wherein the prewelding heat treatment is incorporated into the hot isostatic compaction cycle in which a solely thermal first phase is followed by an external hot pressing phase.

2. The manufacturing process as claimed in claim 1, wherein, prior to the prewelding heat treatment, a shrink-fitting operation is carried out between the facing walls of the lid and of the container, so as to end up with a tight compression fit between the walls.

3. The manufacturing process as claimed in claim 2, wherein the shrink-fitting operation includes at least one of cooling the lid to reduce its dimensions, before the lid is inserted into the cavity and then left to expand upon returning to room temperature, or heating the container to increase dimensions of its cavity by expansion, before the lid is introduced thereinto.

4. A metal part preform assembled during the temperature rise phase of the process according to claim 1, wherein the preform comprises the metal body or container, the reinforcing fiber insert being placed in the cavity formed in the container together with the metal lid placed on the insert in the cavity and fastened to the container.

5. The preform as claimed in claim 4, wherein the cavity comprises a longitudinal first main part housing the insert and at least a second part as an extension of the first part, the lid comprising a central portion covering the insert and at least one prolongation having a shape corresponding to the second part of the cavity so as to partially envelop the insert on at least two different planes.

6. The preform as claimed in claim 5, wherein the lid comprises a progressive deformation zone between the main portion and at least one prolongation.

7. The preform as claimed in claim 4, wherein the insert and the cavity are rectilinear.

8. The preform as claimed in claim 7, wherein the insert has a cross section of polygonal, oval, or circular shape.

9. The preform as claimed in claim 4, wherein the insert is formed from fibers bundled together and coated with metal.

10. A composite metal part produced by carrying out the process as claimed claim 1, comprising at least one cavity of elongate shape incorporating one or more inserts of corresponding shape, the cavity or cavities being placed along one or more rectilinear portions.

11. The manufacturing process as claimed in claim 1, wherein the prewelding heat treatment and hot isostatic compaction cycle are carried out in the same enclosure.

12. The manufacturing process as claimed in claim 1, wherein the lid is completely fastened to the container due to the prewelding heat treatment.

13. The manufacturing process as claimed in claim 1, wherein the lid is partially fastened to the container due to the prewelding heat treatment.

14. The preform as claimed in claim 9, wherein the fibers of the insert are coated with titanium.

* * * * *

UNITED STATES PATENT AND TRADEMARK OFFICE

CERTIFICATE OF CORRECTION

PATENT NO. : 8,776,343 B2
APPLICATION NO. : 13/509022
DATED : July 15, 2014
INVENTOR(S) : Masson et al.

It is certified that error appears in the above-identified patent and that said Letters Patent is hereby corrected as shown below:

In the Specification

Column 4, line 51, delete "the lid now" and insert --the lid 16 now--; and

In the Claims

Column 7, claim 10, line 14, delete "as claimed claim" and insert --as claimed in claim--.

Signed and Sealed this
Ninth Day of December, 2014

Michelle K. Lee

Michelle K. Lee
*Deputy Director of the United States Patent and Trademark Office*